US006874317B2

(12) United States Patent
Sugaya et al.

(10) Patent No.: US 6,874,317 B2
(45) Date of Patent: Apr. 5, 2005

(54) DOUBLE PIPE EXHAUST MANIFOLD

(75) Inventors: Daisuke Sugaya, Tokyo (JP); Katsumi Amada, Tokyo (JP); Satoshi Azuma, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/173,102

(22) Filed: Jun. 18, 2002

(65) Prior Publication Data

US 2003/0006301 A1 Jan. 9, 2003

(30) Foreign Application Priority Data

Jun. 18, 2001 (JP) ..... 2001-183397
Dec. 7, 2001 (JP) ..... 2001-374768

(51) Int. Cl.[7] ..... F01N 7/10

(52) U.S. Cl. ..... 60/323; 60/272; 60/282; 60/312; 60/322

(58) Field of Search ..... 60/322, 323, 272, 60/282, 312, 313, 278

(56) References Cited

U.S. PATENT DOCUMENTS 5,706,655 A 1/1998 Kojima et al.
5,799,395 A * 9/1998 Nording et al. ..... 29/890.08
5,832,723 A * 11/1998 Iwata et al. ..... 60/276
6,082,103 A * 7/2000 Sugiura et al. ..... 60/323
6,155,046 A * 12/2000 Kato et al. ..... 60/323
6,247,552 B1 * 6/2001 Kovar et al. ..... 181/240

FOREIGN PATENT DOCUMENTS

| | | |
|---|---|---|
| JP | 6-10662 | 1/1994 |
| JP | 7-317540 | 12/1995 |
| JP | 9-4447 | 1/1997 |
| JP | 9-88578 | 3/1997 |
| JP | 9-242537 | 9/1997 |
| JP | 10-266844 | 10/1998 |
| JP | 10-266845 | 10/1998 |
| JP | 10-266847 | 10/1998 |
| JP | 10-266848 | 10/1998 |
| JP | 10-266849 | 10/1998 |

* cited by examiner

*Primary Examiner*—Binh Q. Tran
(74) *Attorney, Agent, or Firm*—Foley & Lardner LLP

(57) ABSTRACT

A double pipe exhaust manifold includes an inner pipe, an outer pipe formed in a cylindrical shape by joining at least one side edge thereof by welding, a space retaining member disposed in an annular space defined between the inner pipe and the outer pipe, a connection pipe connecting to a exhaust gas recirculation valve, and a mesh ring. Opening holes are formed in the inner pipe and the outer pipe so that the opening holes are opposed to each in a radial direction of the pipes. The connection pipe is connected to the opening hole of the outer pipe. The mesh ring is interposed between the inner pipe and the outer pipe in a state that the mesh ring plugs an annular opening part defined between opening edges of the opening holes.

31 Claims, 7 Drawing Sheets

DOUBLE PIPE EXHAUST MANIFOLD

BACKGROUND OF THE INVENTION

1. Field of the Invention

The present invention relates to a double pipe exhaust manifold capable of preventing spatter from mixing into an exhaust gas, which is sucked from an inner pipe of the double pipe exhaust manifold, to a connection pipe connecting to an EGR valve.

2. Description of the Related Art

Generally, the exhaust manifold has a double-pipe structure including an inner pipe 101 and an adiabatic outer pipe 102 surrounding the inner pipe, as shown in FIG. 8.

The outer pipe 102 has two pipe members, which are formed so that the outer pipe is divided into two members 102*a* and 102*b* (hence, those pipe members will frequently be referred to as "divided pipe members"), and over lapping parts 102*c* and 102*d* of those divided outer pipe members 102*a* and 102*b* are placed one upon the other and welded by welding 102*e* to thereby form an integral pipe construction.

Normally, connected to the double pipe exhaust manifold is a connection pipe which is connected to an exhaust gas recirculation valve (referred to as an EGR valve) which returns part of the exhaust gas to a suction system of the engine. For the connection of the connection pipe connecting to the EGR valve to the double pipe exhaust manifold, two connection methods are known. A first connection method is that the connection pipe connecting to the EGR valve is directly connected to the double pipe exhaust manifold. A second connection method is that the connection pipe connecting to the EGR valve is connected to a connection member mounted on an exit of the double pipe exhaust manifold.

In the first connection method, as shown in FIG. 9A, opening holes 104 and 105 are formed in the inner pipe 101 and the outer pipe 102, respectively, while being successively arranged in the radial direction. A connection pipe 103 connecting to the EGR valve is connected to the double pipe exhaust manifold in a state that it is communicatively connected to the opening hole 105. In such a construction, part of the exhaust gas passing through the inner pipe 101 is sucked into the connection pipe 103 connecting to the EGR valve, by way of both the opening holes 104 and 105.

In the second connection method, as shown in FIG. 9B, a connection member 106 to which the connection pipe 103 connecting to the EGR valve is connected is mounted between the exit of the double pipe exhaust manifold and catalyst (not shown). In the structure, part of the exhaust gas passing through the inner pipe 101 is sucked into the connection pipe 103 connecting to the EGR valve. Incidentally, in FIG. 9, reference numeral 100 designates space retaining members used for securing an adiabatic space between the inner pipe 101 and the outer pipe 102.

As described above, the double pipe exhaust manifold according to the related art has such a structure that the overlapping parts 102*c* and 102*d* of the divided outer pipe members 102*a* and 102*b* are placed one upon the other and are formed integrally by welding. When the overlapping parts 102*c* and 102*d* of the divided outer pipe members 102*a* and 102*b* are welded together, spatter 107 is scattered into the outer pipe 102 through a gap between the overlapping parts 102*c* and 102*d*, and sticks to the outer side of the inner pipe 101 and the inner side of the of the outer pipe 102.

The spatter 107 may be removed to some amount from the pipes by striking the pipes with a wood hammer after the welding. In this case, however, it is impossible to completely remove the spatter from the pipes. Accordingly, the double pipe exhaust manifold is assembled to the vehicle body in a state that part of the spatter 107 remains in an annular space 101*a* between the inner pipe 101 and the outer pipe 102.

When the inside of the manifold is heated, by the exhaust gas, to be high in temperature during the engine operation, the residual spatter 107 is molten and peeled off by heat and vibration. The spatter mixes into the exhaust gas as sucked from the inner pipe 101 into the connection pipe 103 connecting to the EGR valve, and will strike the EGR valve to deform a shaft of the valve, or will enter the valve to thereby hinder the exact operation of the EGR valve.

The EGR valve of the electronically controlled type which is small in size and light in weight, currently prevails. This type of the EGR valve is sensitive to a very small amount of spatter to possibly operate erroneously or be damaged.

Further, the spatter 107 having passed through the EGR valve enters the suction system of the engine and to the interior of the engine to possibly cause an engine trouble.

SUMMARY OF THE INVENTION

Accordingly, an object of the present invention is to provide a double pipe exhaust manifold which is capable of preventing the spatter left in the annular space between the inner pipe and outer pipe from mixing into an exhaust gas, which is sucked from the inner pipe to a connection pipe connecting to the EGR valve, with provision of a mesh ring for isolating that exhaust gas from an annular space defined between the inner pipe and the outer pipe.

Another object of the present invention is to provide a double pipe exhaust manifold which is capable of perfectly preventing the spatter from remaining in a space between the inner pipe and the outer pipe, which is located near an opening hole to which the connection pipe connecting to the EGR valve is coupled, when the divided outer pipe members are joined together by welding.

According to a first aspect of the invention, there is provided a double pipe exhaust manifold including an inner pipe, an outer pipe formed in a cylindrical shape by joining at least one side edge thereof by welding, a space retaining member disposed in an annular space defined between the inner pipe and the outer pipe, a connection pipe connecting to a exhaust gas recirculation valve, and a mesh ring, in which opening holes are formed in the inner pipe and the outer pipe so that the opening holes are opposed to each in a radial direction of the pipes, the connection pipe is connected to the opening hole of the outer pipe, and the mesh ring is interposed between the inner pipe and the outer pipe in a state that the mesh ring plugs an annular opening part defined between opening edges of the opening holes.

According to a second aspect of the invention, there is provided a double pipe exhaust manifold including an inner pipe, an outer pipe formed in a cylindrical shape by joining at least one side edge thereof by welding, a space retaining member disposed in an annular space defined between the inner pipe and the outer pipe, a connection pipe connecting to a exhaust gas recirculation valve, and a mesh sealing member, in which opening holes are formed in the inner pipe and the outer pipe so that the opening holes are opposed to each in a radial direction of the pipes, the connection pipe is connected to the opening hole of the outer pipe, the the mesh sealing member surrounds a space formed between the opening holes and partitions the space from side edge welding parts of the outer pipe, and the mesh saling member is disposed between the inner pipe and the outer pipe along side edges of the outer pipe.

According to a third aspect of the invention, there is provided the double pipe exhaust manifold according to the second aspect, in which the mesh sealing member serves as a space retaining member.

According to a fourth aspect of the invention, there is provided the double pipe exhaust manifold according to any one of the first to third aspects, in which a top end of the connection pipe protrudes into the annular space between the outer pipe and the inner pipe, while being in non-contact with the inner pipe.

According to a fifth aspect of the invention, there is provided the double pipe exhaust manifold including an inner pipe, an outer pipe formed in a cylindrical shape by joining at least one side edge thereof by welding, a space retaining member disposed in an annular space defined between the inner pipe and the outer pipe, a connection member connected to an exit side of the outer pipe, a connection pipe connecting to a exhaust gas recirculation valve, and a mesh sealing member, in which the connection pipe is connected to the connection member, and the the mesh ring is disposed to plug the annular space.

As described above, according to the first aspect, the mesh ring is interposed between the inner pipe and the outer pipe in a state that it plugs the annular opening part defined between the opening edges of the opening holes. With provision of the mesh ring, there is no chance that the spatter remaining in the annular space mix into the exhaust gas as is sucked from the inner pipe 1 to the connection pipe connecting to the exhaust gas recirculation valve.

Accordingly, the double pipe exhaust manifold of the invention is free from such an unwanted situation inevitable for the conventional technique that the spatter left in the annular space mixes into the exhaust gas sucked from the inner pipe into the connection pipe connecting to the exhaust gas recirculation valve, it strikes the connection pipe connecting to the exhaust gas recirculation valve to deform the shaft of the valve, or enters the valve to thereby hinder the exact operation of the EGR valve. In this respect, the exhaust gas recirculation is protected, and correctly operable.

Further, there is no chance that the spatter having passed passing through the exhaust gas recirculation valve enters the suction system of the engine to possibly cause an engine trouble.

According to the second aspect, the mesh sealing member which surrounds a space formed between said opening holes, and partitions said space from the side edge welding parts of said outer pipe, is disposed between said inner pipe and said outer pipes along the side edge of said outer pipe. This feature of the invention prevents that the spatter is left near the opening hole when the outer pipe members are jointed together, and hence that the spatter enters the exhaust gas recirculation value.

By mounting the $O_2$ sensor or the like in the space surrounded by the mesh sealing member, it is prevented that the $O_2$ sensor is affected by the spatter.

According to the third aspect, the mesh sealing member functions also as a space retaining member. Therefore, the double pipe exhaust manifold prevents the spatter from entering the exhaust gas recirculation without any increase of the number of parts.

According to the fourth aspect, the top end of the connection pipe connecting to the exhaust gas recirculation valve is protruded into the space between the outer pipe and the inner pipe. The tip of the connection pipe so disposed narrows a path through which the spatter left in the space between the inner pipe and the outer pipe moves to the connection pipe connecting to the exhaust gas recirculation valve, and further restricts the flow of the spatter to the EGR valve. Additionally, it more smoothly leads part of the exhaust gas to the connection pipe 7*b* connecting to the exhaust gas recirculation valve.

Further, the connection pipe connecting to the exhaust gas recirculation valve is in non-contact with the inner pipe. This structure eliminates the restriction for the thermal distortion of the inner pipe and hence prevents the reduction of the life of the inner pipe by its thermal fatigue, and prevents noise generation.

According to the fifth aspect, the mesh sealing member is disposed near the exit in a state that said mesh sealing member plugs said annular space. It is avoided that the spatter left in the annular space enters the exhaust gas.

Accordingly, the double pipe exhaust manifold is free from such a problem that the spatter left in the annular space enters the connection pipe connecting to the exhaust gas recirculation valve, strikes the exhaust gas recirculation valve and bends the shaft of the exhaust gas recirculation valve, and it enables the exhaust gas recirculation valve to correctly operate and is improved in reliability.

DETAILED DESCRIPTION OF THE PREFERRED EMBODIMENTS

The preferred embodiments of the present invention will be described with reference to the accompanying drawings.

<Embodiment 1>

A double pipe exhaust manifold A of the instant embodiment is of the type in which a connection pipe connecting to an exhaust gas recirculation valve is directly connected to the double pipe exhaust manifold.

Figure 1:
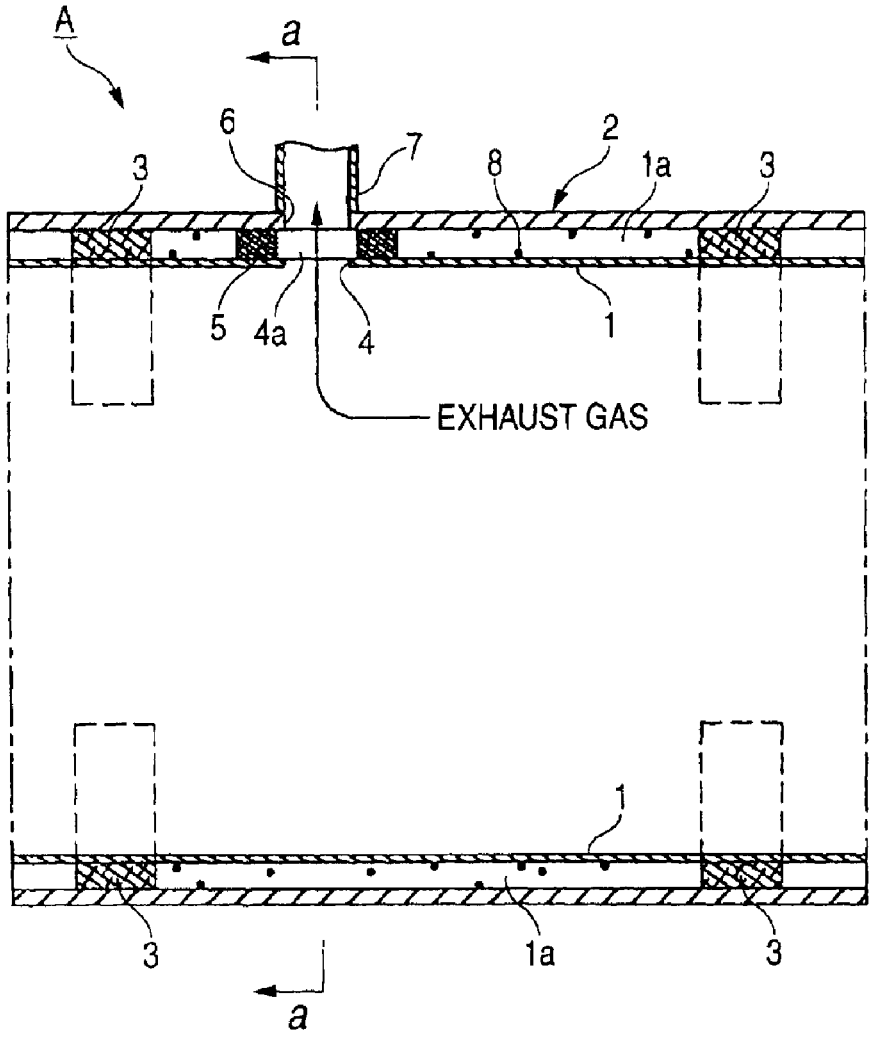
FIG. 1 is a transverse sectional view showing a double pipe exhaust manifold according to an embodiment 1 of the present invention.
Figure 2:
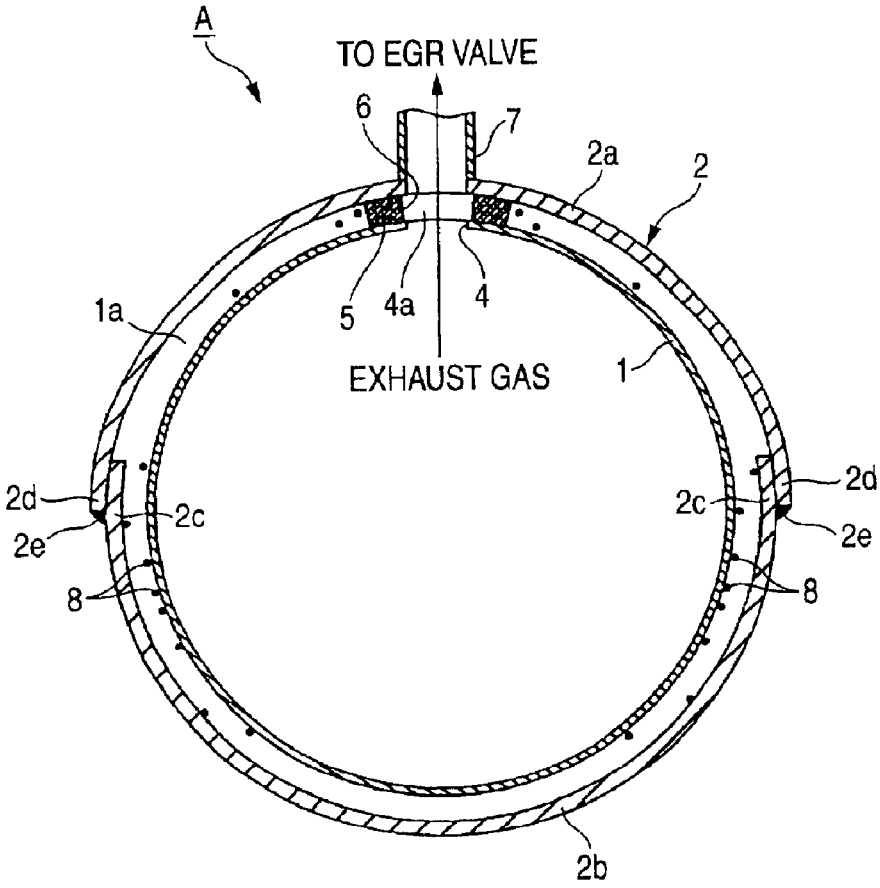
FIG. 2 is a longitudinal sectional view taken on line a—a in FIG. 1 showing the embodiment 1.

FIG. 1 is a transverse sectional view showing the double pipe exhaust manifold A of the instant embodiment. FIG. 2 is a longitudinal sectional view taken on line a—a in FIG. 1.

As shown in FIG. 1, the double pipe exhaust manifold A of the embodiment is installed in an exhaust system ranging between an engine and a catalyst. The double pipe exhaust manifold A mainly includes an inner pipe 1, an outer pipe 2, space retaining members 3, connection pipe 7 connecting to an EGR valve and a mesh ring 5.

A structure of the double pipe exhaust manifold A of the embodiment will first be described.

The double pipe exhaust manifold A rapidly heats up a catalyst contained in the exhaust system of the engine and causes the catalyst to early exercise its purifying function by utilizing the exhaust gas from the engine, in order to facilitate the purifying performance of the vehicle. To this end, the double pipe exhaust manifold A, as shown in FIGS. 1 and 2, has a double pipe structure including the inner pipe 1 and an adiabatic outer pipe 2 surrounding the inner pipe, and includes the space retaining members 3 which are located in an annular space 1*a* defined between the inner pipe 1 and the outer pipe 2.

The space retaining members 3 are brought into contact with the inner pipe 1 and the outer pipe 2, and hence a stainless steel mesh including wires each having a small diameter of about 0.25 mm is used for the space retaining member so as to minimize its thermal conduction.

The inner pipe 1 is formed with a pipe member, circular in cross section, which is made of stainless and has a thin thickness (thickness: 0.5 to 0.8 mm). The outer pipe 2 includes two outer pipe members 2*a* and 2*b* which are configured as if the outer pipe 2 is vertically (radially) divided into two pipe members. Each of those divided outer pipe members 2*a* and 2*b* is manufactured in a manner that a stainless steel plate having a thick thickness (1.5 to 2.0 mm) larger than that of the inner pipe 1 is pressed, and is shaped to be semicircular in cross section.

In the double pipe exhaust manifold A, an opening hole 4 is formed in the inner pipe 1 at a position closer to the rear end thereof, and the mesh ring 5 is fixed to the inner pipe 1 by spot welding while covering the edge of the opening hole 4.

A stainless steel mesh including wires each having a small diameter of about 0.25 mm is used for the mesh ring 5, and is formed to have a thickness such that the mesh ring 5 is in contact with the inner side of the outer pipe 2.

An opening hole 6 is formed in the outer pipe 2 in a state that it communicates to the opening hole 4, and the connection pipe 7 connecting to the EGR valve is communicatively coupled to the opening hole 6.

Accordingly, the mesh ring 5 is interposed between the inner pipe 1 and the outer pipe 2 in a state that the mesh ring 5 plugs an annular opening part 4*a* defined between opening edges of the opening holes 4 and 6.

Assembling work of the double pipe exhaust manifold A will be described.

The double pipe exhaust manifold A is thus constructed in the embodiment of the invention. Accordingly, to assemble the double pipe exhaust manifold A, the space retaining members 3 are first set at predetermined locations on the outer periphery of the inner pipe 1, and the space retaining members 3 are fixed to the outer periphery of the inner pipe 1 by spot welding.

Then, the two divided outer pipe members 2*a* and 2*b* are brought into contact with the outer periphery of the space retaining members 3 and the mesh ring 5, and the two outer pipe members 2*a* and 2*b* are overlapped each other in a radial direction so that both opening holes 4 and 6 communicate with each other. In this state, one outer pipe member is put on the other outer pipe member so as to set up a communicative relation between those members, and overlapping parts 2*c* and 2*d* of them are joined by welding 2*e*. Here, the assembling work ends.

As described above, the double pipe exhaust manifold A of the embodiment has such a structure that the overlapping parts 2*c* and 2*d* of the divided outer pipe members 2*a* and 2*b* are placed one upon the other and welded by welding 2*e* to thereby form an integral pipe construction. When the overlapping parts 2*c* and 2*d* of the divided outer pipe members 2*a* and 2*b* are welded together, spatter 8 is scattered through a gap between the overlapping parts 2*c* and 2*d*, and sticks to the outer side of the inner pipe 1 and the inner side of the of the outer pipe 2.

The spatter 8 may be removed to some amount from the pipes by striking the pipes with a wood hammer after the welding. However, it is impossible to completely remove the spatter from the pipes. Accordingly, part of the spatter 8 remains in an annular space 1*a*, after the double pipe exhaust manifold is assembled to the vehicle body.

When the inside of the manifold is heated to be high in temperature during the engine operation, the residual spatter 8 is molten by heat and vibration and peeled off. The spatter will intend to mix into the exhaust gas as sucked from the inner pipe 1 into the connection pipe 7 connecting to the EGR valve.

It is noted, however, that in the double pipe exhaust manifold A of the embodiment, the mesh ring 5 is interposed between the inner pipe and the outer pipe in a state that the mesh ring 5 plugs the annular opening part 4*a* defined between the opening edges of both opening holes 4 and 6. With provision of the mesh ring 5, there is no chance that the splatter 8 remaining in the annular space 1*a* mix into the exhaust gas as it is sucked from the inner pipe 1 to the connection pipe 7 connecting to the EGR valve.

Accordingly, there is no chance that the spatter 8 enters the connection pipe 7 connecting to the EGR valve, and strikes the EGR valve to deform the shaft of the valve, or enters the valve to thereby hinder the exact operation of the EGR valve.

<Embodiment 2>

A double pipe exhaust manifold according to an embodiment 2 of the invention will be described.

A double pipe exhaust manifold B of the embodiment is different from that of the embodiment 1 in that the mesh ring of the embodiment 1 is substituted by a mesh sealing member 5*a*, which is interposed between the inner pipe and the outer pipe at positions along the inner parts of the welding joint edges of the outer pipe, and surrounds a space formed between the opening holes of the inner pipe and the outer pipe. Further, the instant embodiment is different from the embodiment 1 in that the space retaining members 3 used in the embodiment 1 are omitted, and the mesh sealing member 5*a* serves also as a space retaining member.

Figure 3:
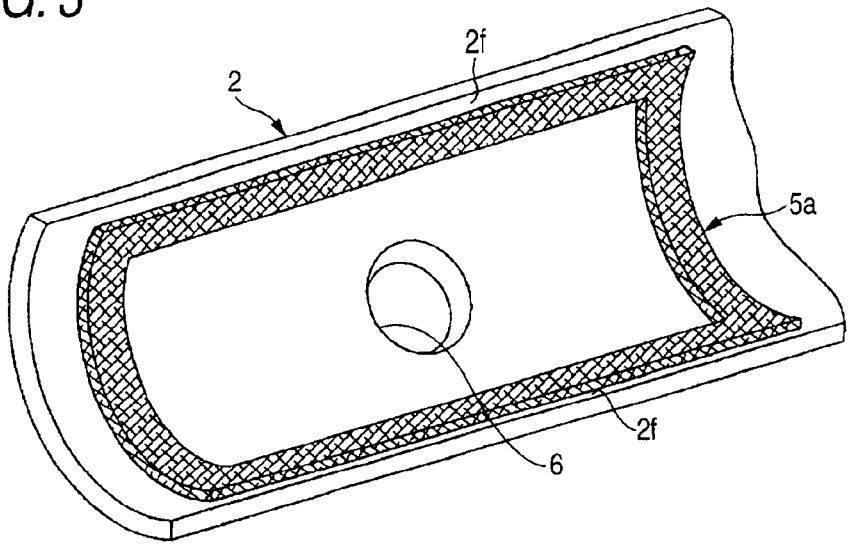
FIG. 3 is a perspective view showing an outer pipe 2 of a double pipe exhaust manifold B according to an embodiment 2 before it is assembled.
Figure 4:
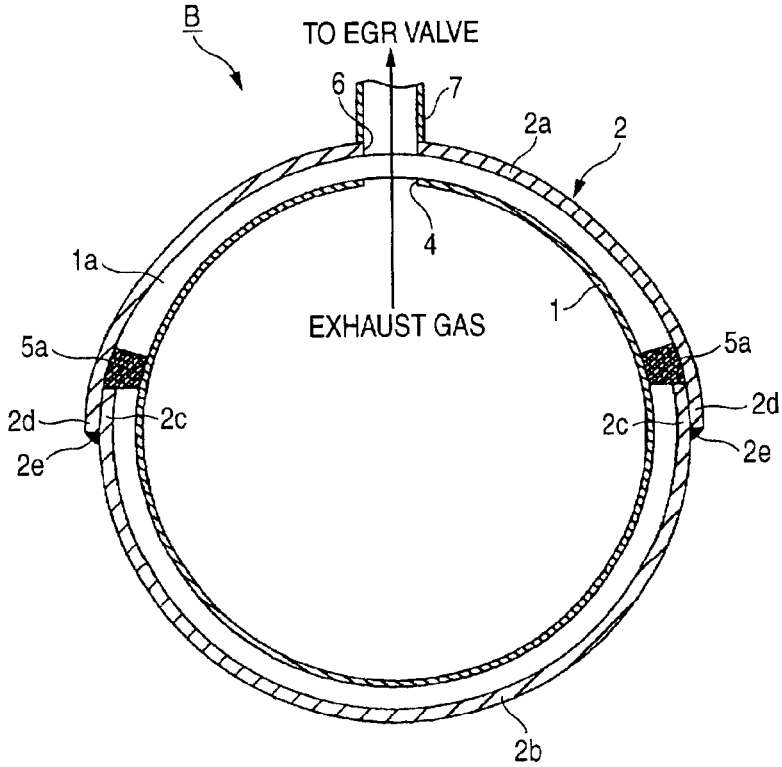
FIG. 4 is a longitudinal sectional view showing the double pipe exhaust manifold B according to the embodiment 2.

FIG. 3 is a perspective view showing the outer pipe 2 of the double pipe exhaust manifold B in the instant embodiment before it is assembled. FIG. 4 is a longitudinal sectional view showing the double pipe exhaust manifold B of the instant embodiment.

Figure 8:
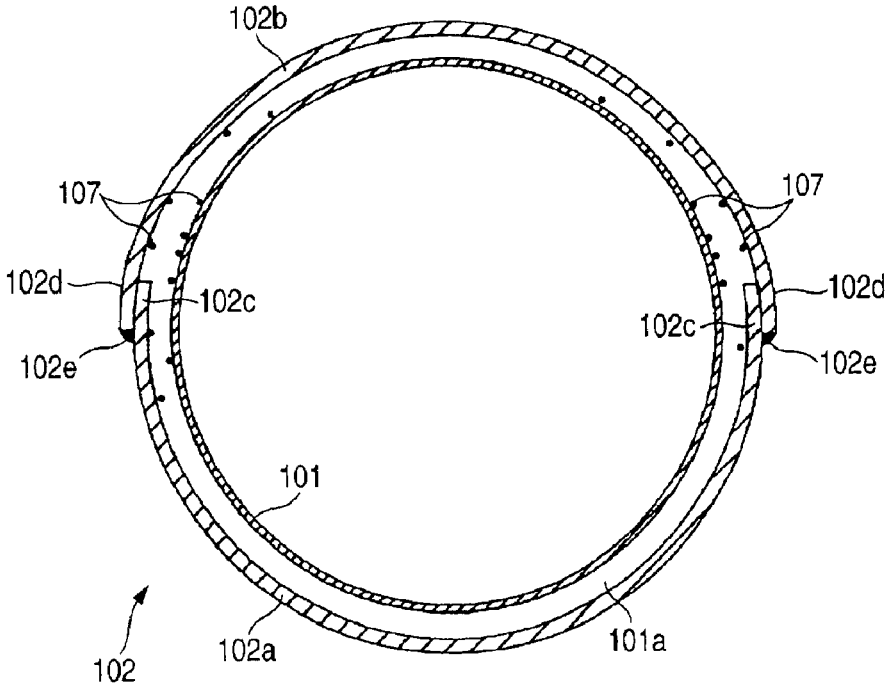
FIG. 8 is a longitudinal sectional view showing a double pipe exhaust manifold according to the related art.
Figure 9A:
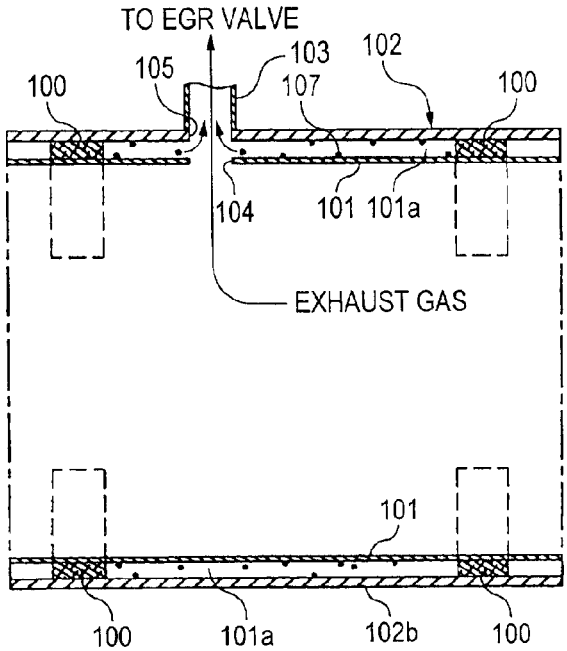
FIG. 9A is a transverse sectional view showing a double pipe exhaust manifold according to the related art in which a connection pipe connecting to an EGR valve is directly connected to the double pipe exhaust manifold.
Figure 9B:
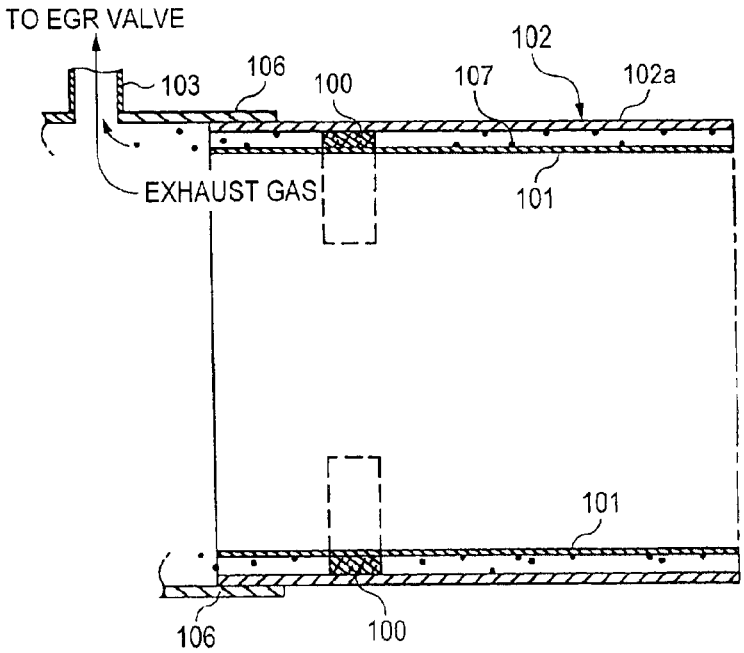
FIG. 9B is a transverse sectional view showing a double pipe exhaust manifold according to the related art in which the connection pipe connecting to the EGR valve is connected to an exit of the double pipe exhaust manifold.

The double pipe exhaust manifold B is of the type in which the connection pipe connecting to an EGR valve is directly connected to the circumferential surface thereof. As described also in the related art discussion, one of the causes of the unwanted situation that the spatter 107 is generated between the inner pipe 101 and the outer pipe 102 and left thereon is that in welding together the overlapping parts 102*c* and 102*d*, spatter 107 is scattered through a gap between the overlapping parts 102*c* and 102*d*, and sticks to the outer side of the inner pipe 101 and the inner side of the of the outer pipe 102 (see FIGS. 8 and 9).

Then, in the double pipe exhaust manifold B of the embodiment, to prevent spatter from being generated and remaining between the inner pipe 1 and the outer pipe 2, as shown in FIGS. 3 and 4, a mesh sealing member 5*a* is interposed between the inner pipe 1 and the outer pipe 2 and along the inner sides 2*f* of the welding joint edges of the outer pipe 2, while surrounding the opening hole 6 of the outer pipe 2.

The mesh sealing member 5*a* is formed with a stainless steel mesh including wires each having a small diameter of about 0.25 mm, and has a thickness large enough to be brought into contact with the outer side of the inner pipe when it is assembled. Further, the mesh sealing member is fixed to the outer pipe 2 by spot welding.

A process of assembling the double pipe exhaust manifold B is substantially the same as that of the embodiment 1, except that before the outer pipe members 2*a* and 2*b* are jointed together to form an integral pipe construction, the mesh sealing member 5*a* is set at a predetermined position and the overlapping parts 2*c* and 2*d* are welded together in a state that the mesh sealing member 5*a* is brought into contact with the outer side of the inner pipe 1.

In the double pipe exhaust manifold B of the embodiment, when the overlapping parts 2*c* and 2*d* are joined together by welding 2*e*, and the spatter will enter the inside of the outer pipe 2 (inner space between the inner pipe 1 and the outer pipe 2) through a gap present between the overlapping parts 2*c* and 2*d*, the spatter is blocked in its entering by the mesh sealing member 5*a*, which is interposed between the inner pipe 1 and the outer pipe 2 and along the inner sides 2*f* of the welding joint edges of the outer pipe 2.

Further, in the embodiment, the mesh sealing member 5*a* is interposed between the inner pipe 1 and the outer pipe 2 while surrounding the space formed between the opening holes 4 and 6. With this structural feature, there is no chance that the sputter material remains in the space between the inner pipe 1 and the outer pipe 2, which is located near the opening hole 6, and the spatter is perfectly prevented from mixing into the exhaust gas which is sucked from the inner pipe 1 into the connection pipe 7 connecting to the EGR valve.

In addition, the mesh ring 5 functions also as a spacer retaining member situated in the annular space 1*a* defined between the inner pipe 1 and the outer pipe 2. Therefore, the double pipe exhaust manifold of the embodiment is capable of preventing the spatter from entering the pipe connecting to the EGR valve by using parts whose number is equal to that of the double pipe exhaust manifold according to the related art.

<Embodiment 3>

A double pipe exhaust manifold according to an embodiment 3 of the invention will be described.

A double pipe exhaust manifold C of the embodiment is different from that of the embodiment 1 in that the top end of the connection pipe connecting to the EGR valve is protruded into the space between the outer pipe and the inner pipe.

Figure 5:
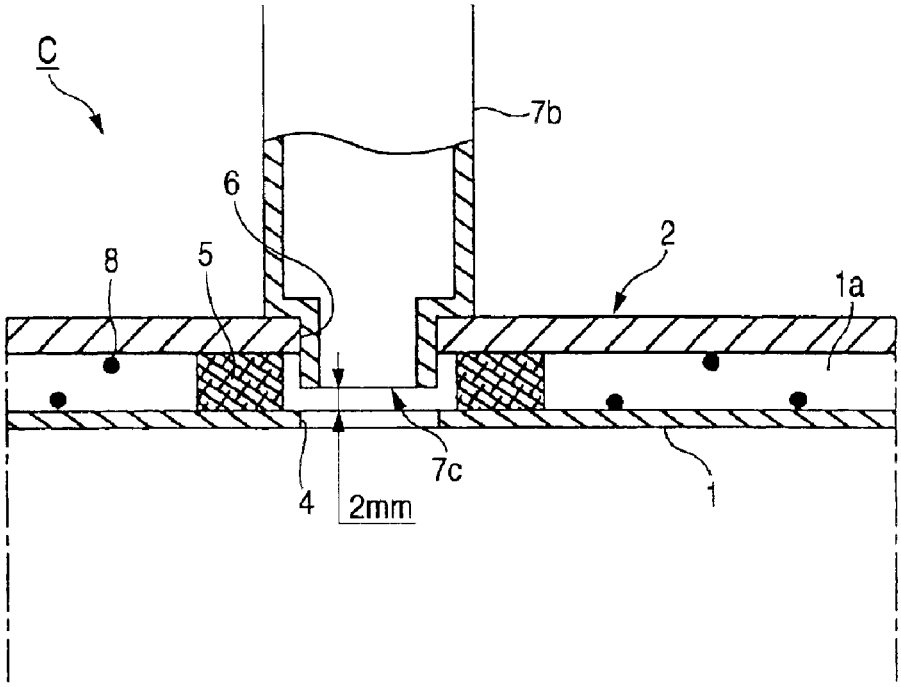
FIG. 5 is a transverse sectional view showing a connection pipe 7*b* connecting to an EGR valve in a double pipe exhaust manifold C according to an embodiment 3 of the invention.

FIG. 5 is a transverse sectional view showing a connection pipe connecting to the EGR valve in the double pipe exhaust manifold C of the embodiment.

As shown in the figure, in the double pipe exhaust manifold C, the top end 7*c* of a connection pipe 7*b* connecting to the EGR valve is connected to the opening hole 6 of the outer pipe 2, while protruding into the space between the inner pipe 1 and the outer pipe 2.

The top end 7*c* of the connection pipe 7*b* connecting to the EGR valve is connected to the opening hole 6 of the outer pipe 2 in a state that a gap of about 2 mm is present between the top end thereof and the inner pipe 1.

The gap is provided for avoiding such a situation that the top end 7*c* and the inner pipe 1 is brought into contact when the inner pipe 1 expands by exhaust heat. This structure eliminates the restriction for the thermal distortion of the inner pipe 1 and hence prevents the reduction of the life of the inner pipe by its thermal fatigue, and prevents noise generation.

In the double pipe exhaust manifold of the embodiment, the top end 7*c* of the connection pipe 7*b* connecting to the EGR valve is located in the space between the inner pipe 1 and the outer pipe 2. The top end 7*c* of the connection pipe so disposed narrows a path through which the splatter left in the space between the inner pipe 1 and the outer pipe 2 moves to the connection pipe 7*b* connecting to the EGR valve, and further restricts the flow of the splatter 8 to the EGR valve. Additionally, it more smoothly leads part of the exhaust gas to the connection pipe 7*b* connecting to the EGR valve.

Also in a case where a very small amount of foreign material is produced, for example, by welding the connection pipe 7*b* connecting to the EGR valve to the opening hole 6, it is difficult that the foreign material enters the connection pipe 7*b* connecting to the EGR valve.

<Embodiment 4>

An embodiment 4 of the invention will be described.

A double pipe exhaust manifold D of the instant embodiment of the invention is of the type in which a connection pipe connecting to the EGR valve is connected to the exit of the double pipe exhaust manifold.

Figure 6:
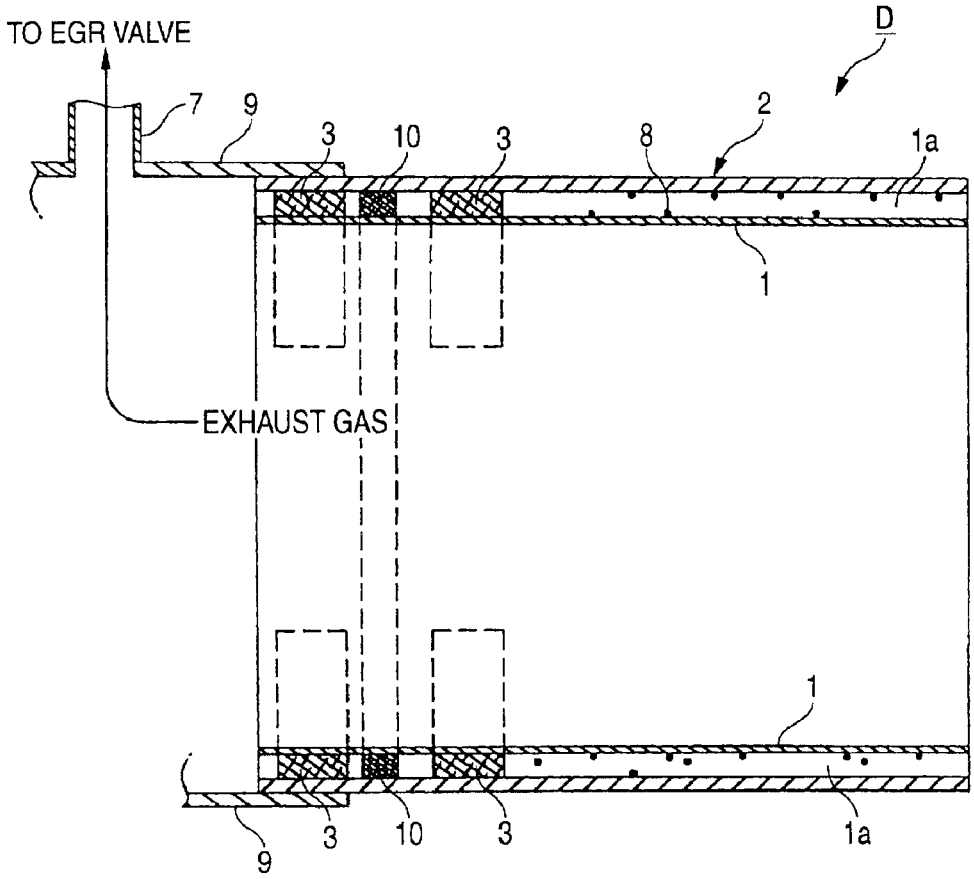
FIG. 6 is a transverse sectional view showing a double pipe exhaust manifold D according to an embodiment 4 of the invention.

FIG. 6 is a transverse sectional view showing a double pipe exhaust manifold D according to an embodiment 4 of the invention.

As shown in FIG. 6, in the double pipe exhaust manifold D of the instant embodiment, a connection pipe 7 connecting to the EGR valve is connected to the exit of the double pipe exhaust manifold D through a connection member 9.

In an annular space 1*a* which is located near the exit of the double pipe exhaust manifold D between the inner pipe l and the outer pipe 2, the mesh ring 10 is brought into contact with the outer side of the inner pipe 1 and the inner side of the outer pipe 2 in a state that space retaining members 3, 3 sandwitches the mesh ring 10 therebetween. And the mesh ring 10 is slidable between the space retaining members 3, 3 in the axial direction of the double pipe exhaust manifold D.

The mesh ring 10 is formed with a stainless mesh whose wire is a thin wire of, for example, about 0.25 mm in diameter, and has a thickness large enough to be in contact with the inner side of the outer pipe 2.

The process of assembling the double pipe exhaust manifold D of the instant embodiment is similar to that of the embodiment 1 except that before the divided outer pipe members 2*a* and 2*b* are jointed together, the mesh ring 10 is placed at a predetermined position, and the overlapping parts 2*c* and 2*d* are welded together in a state that the mesh ring is in contact with the outer side of the inner pipe 1 and the inner side of the outer pipe 2. Hence, no description about the assembling process will be given.

In the double pipe exhaust manifold D of the embodiment, part of the spatter 8 remains in an annular space 1*a* after the double pipe exhaust manifold is assembled to the vehicle body.

During the engine operation, the spatter 8 is molten and peeled off. In the double pipe exhaust manifold D of the embodiment, as described above, the mesh ring 10 is interposed between the inner pipe and the outer pipe in a state that it plugs the annular opening part 1*a* near the exit of the double pipe exhaust manifold. Therefore, it is prevented that the spatter 8 left in the annular space 1*a* mixes in the exhaust gas sucked from the inner pipe 1 into the connection pipe 7 connecting to the EGR valve.

Accordingly, the double pipe exhaust manifold is free from such a problem that the spatter 8 enters the connection pipe 7 connecting to the EGR valve, strikes the EGR valve and bends the shaft of the EGR valve, and it enables the EGR valve to correctly operate and is improved in reliability.

Further, it is noted that the mesh ring 10 is slidable between the space retaining members 3 in the axial direction of the double pipe exhaust manifold D. With this unique feature, when the inner pipe 1 is thermally expanded and slides relative to the outer pipe 2, the double pipe exhaust manifold flexibly copes with such a situation since the mesh ring 10 axially slides between the space retaining members 3. Further, it is prevented that it moves to the entrance of the double pipe exhaust manifold D.

While some specific embodiments have been described, it should be understood that the invention is not limited to those described embodiments, but may variously be modified, altered and changed within the true spirits of the invention.

In the embodiment 1, the mesh ring 5 is connected to the inner pipe 1 by spot welding in a state that it covers the outer peripheral edge of the opening hole 4. However, those skilled persons in the art will readily take the following measures for the sliding of the inner pipe 1 to the outer pipe 2 when the former is thermally expanded: the outside diameter of the mesh ring 5 is increased or the mesh ring is axially slidable relative to the inner pipe 1.

Figure 7:
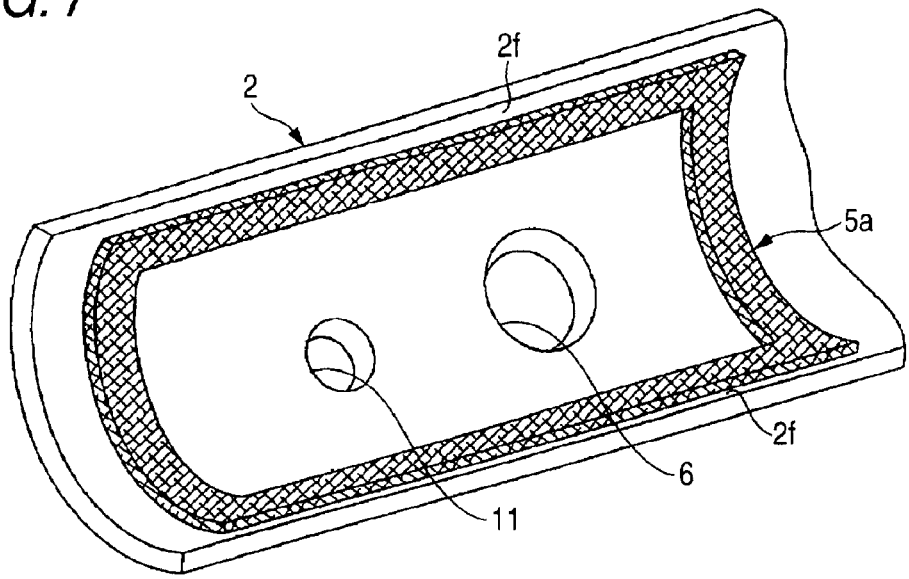
FIG. 7 is a perspective view showing a structure of the double pipe exhaust manifold B according to the embodiment 2 in which a mounting hole 11 for various sensors is formed near an opening hole.

The mesh sealing member 5*a* in the embodiment 2 surrounds the opening hole 6 of the outer pipe 2 to which the connection pipe 7 connecting to the EGR valve is connected. Further, as shown in FIG. 7, a mounting hole 11 for various sensors, such as an $O_2$ sensor, which will be affected when spatter or foreign material mixes in the exhaust gas from the inner pipe 1, may be formed near the opening hole 6. By so doing, the sensor is made free from the spatter or the like.

The entire contents of Japanese Patent Application No. 2001-183397, filed Jun. 18, 2001, and Japanese Patent Application No. 2001-374768, filed Dec. 7, 2001, are herein incorporated by reference.

What is claimed is:

1. A double pipe exhaust manifold comprising:

an inner pipe;

an outer pipe formed in a cylindrical shape by joining at least one side thereof along a longitudinal direction of the outer pipe by welding;

a space retaining member disposed in an annular space defined between the inner pipe and the outer pipe;

a connection pipe connecting to a exhaust gas recirculation valve; and a mesh ring, wherein opening holes are formed in the inner pipe and the outer pipe so that the opening holes are opposed to each in a radial direction of the pipe;

wherein the connection pipe is connected to the opening hole of the outer pipe;

wherein the mesh ring is interposed between the inner pipe and the outer pipe in a state that the mesh ring plugs an annular opening part defined between opening edges of the opening holes; and wherein the mesh ring is fixed to at least one of the inner pipe and the outer pipe by welding.

2. A double pipe exhaust manifold comprising:

an inner pipe;

an outer pipe formed in a cylindrical shape by joining at least one side thereof by welding;

a space retaining member disposed in an annular space defined between the inner pipe and the outer pipe;

a connection pipe connecting to a exhaust gas recirculation valve; and a mesh sealing member, wherein opening holes are formed in the inner pipe and the outer pipe so that the opening holes are opposed to each in a radial direction of the pipe;

wherein the connection pipe is connected to the opening hole of the outer pipe;

wherein the the mesh sealing member surrounds a space formed between the opening holes and partitions the space from side edge welding parts of the outer pipe;

wherein the mesh saling member is disposed between the inner pipe and the outer pipe along side edges of the outer pipe; and wherein the mesh sealing member is fixed to at least one of the inner pipe and the outer pipe by welding.

3. The double pipe exhaust manifold according to claim 2, wherein the mesh sealing member serves as a space retaining member.

4. The double pipe exhaust manifold according to claim 1, wherein a top end of the connection pipe protrudes into the annular space between the outer pipe and the inner pipe, while being in non-contact with the inner pipe.

5. The double pipe exhaust manifold according to claim 2, wherein a top end of the connection pipe protrudes into the annular space between the outer pipe and the inner pipe, while being in non-contact with the inner pipe.

6. A double pipe exhaust manifold comprising:

an inner pipe;

an outer pipe formed in a cylindrical shape by joining at least one side thereof by welding;

a space retaining member disposed in an annular space defined between the inner pipe and the outer pipe;

a connection member connected to an exit side of the outer pipe;

a connection pipe connecting to a exhaust gas recirculation valve; and a mesh ring, wherein opening holes are formed in the inner pipe and the outer pipe so that the opening holes are opposed to each other in a redial direction of the pipe;

wherein the connection pipe is connected to the connection member;

wherein the the mesh ring is disposed to plug the annular space, and wherein the space retaining member is fixed to at least one of the inner pipe And the outer pipe by welding.

7. The double pipe exhaust manifold according to claim 6, wherein the space retaining member includes a first space retaining element and a second space retaining element, and wherein the mesh ring is sandwiched between the first and the second space retaining elements and slides within a portion of the annular space that exists between the first and second space retaining members.

8. The double pipe exhaust manifold according to claim 1, wherein the mesh ring is only provided at predetermined locations in the annular space, and wherein air gaps exist in the annular space at locations other than the predetermined locations.

9. The double pipe exhaust manifold according to claim 2, wherein the mesh sealing member is only provided at predetermined locations in the annular space, and wherein air gaps exist in the annular space at locations other than the predetermined locations.

10. The double pipe exhaust manifold according to claim 6, wherein the mesh ring is only provided at predetermined locations in the annular space, and wherein air gaps exist in the annular space at locations other than the predetermined locations.

11. A double pipe exhaust manifold comprising:

an inner pipe;

an outer pipe formed in a cylindrical shape by joining at least one side thereof by welding;

a mesh sealing member disposed in an annular space defined between the inner pipe and the outer pipe; and a connection pipe connecting to an exhaust gas recirculation valve, wherein opening holes are formed in the inner pipe and the outer pipe so that the opening holes are opposed to each other in a radial direction of the pipe;

wherein the connection pipe is connected to the opening hole of the outer pipe;

wherein the mesh sealing member surrounds a space formed between the opening holes and partitions the space from the side edge welding parts of the outer pipe;

wherein the mesh sealing member is disposed between the inner pipe and the outer pipe along the side edges of the outer pipe;

wherein the mesh sealing member also operates as a space retaining member for retaining a predetermined spacing between the inner pipe and the outer pipe during operation of the double pipe exhaust manifold; and wherein the mesh sealing member is fixed to at least one of the inner pipe and the outer pipe by welding.

12. The double pipe exhaust manifold according to claim 1, wherein the mesh ring is located adjacent to the annular opening part and at no other location in the annular opening.

13. The double pipe exhaust manifold according to claim 2, wherein the outer pipe includes a first outer pipe element welded to a second outer pipe element at first and second places to form the outer pipe;

wherein the mesh sealing member includes a first mesh sealing element located adjacent to a first place, and a second mesh sealing element located adjacent to the second place.

14. The double pipe exhaust manifold according to claim 1, wherein the mesh ring is a metal component that is configured to be welded in place to at least one of the inner pipe and the outer pipe, at a predetermined location within the annular space.

15. The double pipe exhaust manifold according to claim 1, wherein the mesh ring is welded to both the inner pipe and to the outer pipe.

16. The double pipe exhaust manifold according to claim 1, wherein the space retaining member includes a first space retaining member disposed adjacent to a first side of the connection pipe within the annular space, and a second space retaining member disposed adjacent to a second side of the connection pipe with the annular space.

17. The double pipe exhaust manifold according to claim 1, wherein the space retaining member comprises a plurality of stainless steel wires each having about a 2.5 micron diameter.

18. The double pipe exhaust manifold according to claim 1, wherein the annular space comprises:

a first air gap provided between a first side of the space retaining member and the mesh ring; and a second air gap provided between a second side of the space retaining member and the mesh ring.

19. The double pipe exhaust manifold according to claim 16, wherein the annular space comprises:

a first air gap provided between the first space retaining member and the mesh ring;

a second air gap provided between the mesh ring and the second space retaining member; and a third gap provided between the first and second space retaining members.

20. The double pipe exhaust manifold according to claim 7, wherein the first and second space retaining members are held in place at predetermined positions within the annular space, and wherein the mesh ring slides in the portion of the annular space that exists between the first and second space retaining members and is capable of coming into contact with the first and second space retaining members.

21. The double pipe exhaust manifold according to claim 2, wherein the mesh sealing member is welded to both the inner pipe and to the outer pipe.

22. The double pipe exhaust manifold according to claim 2, wherein the space retaining member includes a first space retaining member disposed adjacent to a first side of the connection pipe within the annular space, and a second space retaining member disposed adjacent to a second side of the connection pipe within the annular space.

23. The double pipe exhaust manifold according to claim 2, wherein the space retaining member comprises a plurality of stainless steel wires each having about a 2.5 micron diameter.

24. The double pipe exhaust manifold according to claim 2, wherein the annular space comprises:

a first air gap provided between a first side of the space retaining member and the mesh sealing member; and a second air gap provided between a second side of the space retaining member and the mesh sealing member.

25. The double pipe exhaust manifold according to claim 22, wherein the annular space comprises:

a first air gap provided between the first space retaining member and the mesh sealing member;

a second air gap provided between the mesh sealing member and the second space retaining member; and a third air gap provided between the first and second space retaining members.

26. The double pipe exhaust manifold according to claim 6, wherein the mesh ring is welded to both the inner pipe and to the outer pipe.

27. The double pipe exhaust manifold according to claim 6, wherein the space retaining member includes a first space retaining member disposed adjacent to a first side of the connection pipe within the annular space, and a second space retaining member disposed adjacent to a second side of the connection pipe within the annular space.

28. The double pipe exhaust manifold according to claim 6, wherein the space retaining member comprises a plurality of stainless steel wires each having about a 2.5 micron diameter.

29. The double pipe exhaust manifold according to claim 6, wherein the annular space comprises:

a first air gap provided between a first side of the space retaining member and the mesh ring; and a second air gap provided between a second side of the space retaining member of the mesh ring.

30. The double pipe exhaust manifold according to claim 27, wherein the annular space comprises:

a first air gap provided between the first space retaining member and the mesh ring;

a second air gap provided between the first and second space retaining member; and a third air gap provided between the first and second space retaining members.

31. The double pipe exhaust manifold according to claim 11, wherein the mesh sealing is welded to both the inner pipe and to the outer pipe.

* * * * *